US005326645A

United States Patent [19]

Ashary et al.

[11] Patent Number: 5,326,645

[45] Date of Patent: Jul. 5, 1994

[54] NICKEL-CHROMIUM CORROSION COATING AND PROCESS FOR PRODUCING IT

[75] Inventors: Adil A. Ashary, Indianapolis; Robert C. Tucker, Jr., Brownsburg, both of Ind.

[73] Assignee: Praxair S.T. Technology, Inc., Danbury, Conn.

[21] Appl. No.: 847,192

[22] Filed: Mar. 6, 1992

[51] Int. Cl.[5] ..... B21D 39/00; B05D 1/36; B05D 7/00

[52] U.S. Cl. ..... 428/552; 428/621; 428/622; 427/456; 427/419.2; 427/419.3; 427/419.7

[58] Field of Search ..... 427/456, 419.3, 419.2, 427/419.7; 428/548, 552, 553, 564, 621, 622

[56] References Cited

U.S. PATENT DOCUMENTS

| | | | |
|---|---|---|---|
| 4,095,003 | 7/1978 | Weatherly et al. | 427/34 |
| 4,389,251 | 7/1983 | Simm et al. | 75/225 |
| 4,453,976 | 7/1984 | Smythe | 75/251 |
| 4,529,616 | 7/1985 | Smythe | 427/34 |
| 4,609,401 | 9/1986 | Simm et al. | 75/252 |
| 4,902,539 | 2/1990 | Jackson | 427/423 |

OTHER PUBLICATIONS

"Electrochemical and Long-Term Corrosion Studies of Several Alloys in Bare Condition and Plasma Sprayed with $Cr_2O_3$", A. A. Ashary and R. C. Tucker, Jr., Surface and Coatings Technology, 43/44 (1990) pp. 567-576, copyright Elsevier Sequoia/Printed in The Netherlands.

"Standard Test Method for Conducting Cyclic Potentiodynamic Polarization Measurements For Localized Corrosion Susceptibility of Iron-, Nickel-, or Cobalt-Based Alloys", pp. 345-351, Test method is under the jurisdiction of ASTM Committee G-1 on Corrosion of Metals and is the direct responsibility of Subcommittee G.01 on Electrochemical Measurement Corrosion Testing, Current edition approved Nov. 28, 1986, published Jan., 1987.

Katsumata et al., Japanese Abstract, Application No. 62-168581, Jul. 8, 1987.

Ishizawa, Japanese Abstract, Application No. 61-24330, Feb. 6, 1986.

*Primary Examiner*—Donald P. Walsh
*Assistant Examiner*—Anthony R. Chi
*Attorney, Agent, or Firm*—Cornelius O'Brien

[57] ABSTRACT

An impervious corrosion resistance nickel-chromium coating on a metallic substrate, such as an iron-containing alloy substrate that protects the substrate from a corrosive media and the process for producing the coating on the substrate.

19 Claims, 2 Drawing Sheets

NICKEL-CHROMIUM CORROSION COATING AND PROCESS FOR PRODUCING IT

FIELD OF THE INVENTION

The invention relates to an impervious nickel-chromium coating that when subjected to the standard corrosion test according to ASTM G-61, a current of less than 50 microamperes per cubic centimeters results with an applied potential of 400 millivolts (mV). The invention also relates to a process for producing the coating.

BACKGROUND OF THE INVENTION

Iron-containing alloys, such as different grades of steel and stainless steels, are subject to corrosion when exposed to aqueous environments. Thermally-sprayed coatings are frequently used in corrosive environments to provide wear resistance. There are many thermal spray coatings whose corrosion characteristics are superior to iron-containing alloys. The use of such wear and corrosion resistant coatings may be limited by the corrosion behavior of the substrate. This is because of the interconnected porosity which is inherently present in thermally-sprayed coatings. This interconnected porosity may allow the corrosive media to reach the coating substrate interface. An example of the problem is the use of a plasma-sprayed $Cr_2O_3$ coating on a 300 series stainless steel substrate in sea water. This coating/substrate combination is frequently used for applications such as mechanical seals. The $Cr_2O_3$ coating itself has good wear and corrosion resistance, but the stainless steels are susceptible to crevice corrosion. Consequently, $Cr_2O_3$ coatings on 300 series stainless steels frequently fail in a sea water environment. The fabrication of mechanical seals from nickel base corrosion resistant alloys is expensive. Weld deposited overlays of nickel base corrosion resistant alloys on iron base alloys have both technical and cost problems.

It is an object of the present invention to provide an impervious coating for a metallic alloy substrate, such as an iron-containing alloy, a copper-containing alloy, a cobalt-containing alloy, an aluminum-containing alloy, or a nickel-containing alloy, that can be used in aqueous environments.

It is another object of the present invention to provide a process for protecting a metallic alloy from aqueous corrosion by applying an impervious coating to such alloy.

The foregoing and additional objects will become more apparent from the description and disclosure hereinafter.

SUMMARY OF THE INVENTION

The invention relates to a process for protecting a metallic alloy from aqueous corrosion by applying an impervious coating to such alloy comprising the steps:

(a) preparing a metallic alloy substrate;

(b) preparing a powder comprising between about 21 to 23 weight percent chromium, between about 8 to 10 weight percent molybdenum, between about 2.5 to 3.5 weight percent iron, between about 3 to 4 weight percent niobium, and remainder substantially nickel; and (c) depositing the powder composition of step (b) with a thermal spray device at a suitable gas temperature and gas pressure onto the substrate to produce a coating in excess of 0.0035 inch thick and having the characteristics such that when subjected to the ASTM G-61 corrosion test, a current density of less than 50 microamperes per square centimeter, preferably less than 25 microamperes per square centimeter, results when a potential of 400 millivolts is applied.

Achieving a current density of less than 50 microamperes per $cm^2$ at an applied potential of 400 millivolts will insure that the coating is impervious and will not permit liquid to penetrate through the coating and contact the surface of the substrate. Thus a wear resistance coating, such as aluminum oxide, chromium oxide, titanium oxide, mixed oxides of aluminum oxide and titanium, tungsten carbide-cobalt cermets, tungsten carbide-nickel cermets, tungsten carbide-chromium-cobalt cermets, tungsten carbide-chromium-nickel cermets, chromium carbide-nickel-chromium cermets, chromium carbide-IN-625 cermets, and tungsten-titanium carbide-nickel cermets could be deposited on the coating of this invention as a top coat to provide wear resistance for the coated article. This coated article could then be used in an aqueous corrosion environment and the undercoat of this invention will prevent any of the aqueous media from penetrating through to the substrate.

Preferably the powder composition of this invention should comprise about 22 weight percent chromium; about 9 weight percent molybdenum; about 3 weight percent iron; about 3.5 weight percent niobium; and remainder substantially nickel such as about 62.5 weight percent nickel. The thickness of the coating should be greater than 0.0035 inch, preferably greater than 0.004 inch and most preferably greater than 0.006 inch. One purpose of the coating is to provide an impervious layer for a metallic alloy substrate that will prevent a corrosive media from permeating through the coating to contact the surface of the substrate. Thus a wide variety of substrates can be used in an aqueous environment since the coating of this invention will protect the substrate from the corrosive media. Suitable substrates would include various grades of stainless steels such as AISE 304, AISE 316, or AISE 410 stainless steel, other austenitic, ferritic, martensitic, or precipitation hardened stainless steels, plain carbon steel such as AISE 1018, and alloy steels such as AISE 4140. Other substrates could be used such as copper-base alloys, aluminum-base alloys, nickel-base alloys, and cobalt-base alloys.

The coating of this invention could function as a barrier coating onto which a top coat could be applied for a particular application. For example, if wear resistant characteristics are required, a coating such as chromium carbide cermets, tungsten carbide cermets or oxides could be applied by any conventional method, such as plasma spraying, flame plating, high velocity oxy-fuel, or detonation gun. The wear resistant top coats that can be used include chromium oxide, aluminum oxide, titanium oxide, mixed oxides of aluminum chromium and titanium, tungsten carbide cermets, tungsten carbide-cobalt cermets, tungsten carbide-chromium-cobalt cermets, tungsten carbide-nickel-chromium cermets, chromium carbide-IN-625 cermets, tungsten carbide-nickel cermets, tungsten-titanium carbide-nickel cermets and chromium carbide-nickel-chromium cermets.

In applying the coating of this invention, the thermal spraying process should be used to insure that the proper gas temperature and gas pressure are obtained when propelling the powders onto the surface of the substrate. Preferably, the powders of the coating composition of this invention should be applied onto the surface of the substrate at a gas temperature from about 3000° F. to 5800° F. at a gas pressure of from about 11 arm to 18 arm, and to a thickness of at least greater than 0.0035 inch. Most preferably, the gas temperature should be from about 3200° F. to 5600° F. and the gas pressure should be from about 12 atm to about 16.5 atm.

Thus to insure that the proper gas temperature and gas pressure are obtained, a thermal spraying process should be used. Thermal spraying by means of detonation consists of a fluid-cooled barrel having a small inner diameter of about one inch. Generally a mixture of oxygen and acetylene is fed into the gun along with a comminuted coating material. The oxygen-acetylene fuel gas mixture is ignited to produce a detonation wave which travels down the barrel of the gun whereupon the coating material is heated and propelled out of the gun onto an article to be coated. U.S. Pat. No. 2,714,563 discloses a method and apparatus which utilizes detonation waves for thermal spray coating. The disclosure of this U.S. Pat. No. 2,714,563 is incorporated herein by reference as if the disclosure was recited in full text in this specification.

In general, when the fuel gas mixture in a detonation gun is ignited, detonation waves are produced whereupon the comminuted coating material is accelerated to about 2400 ft/sec and heated to a temperature near its melting point. After the coating material exits the barrel of the detonation gun, a pulse of nitrogen purges the barrel. This cycle is generally repeated about four to eight times a second. Control of the detonation coating is obtained principally by varying the detonation mixture of oxygen to acetylene.

In some applications it was found that improved coatings could be obtained by diluting the oxygen-acetylene fuel mixture with an inert gas such as nitrogen or argon. The gaseous diluent has been found to reduce or tend to reduce the flame temperature since it does not participate in the detonation reaction. U.S. Pat. No. 2,972,550 discloses the process of diluting the oxygen-acetylene fuel mixture to enable the detonation-plating process to be used with an increased number of coating compositions and also for new and more widely useful applications based on the coating obtainable. The disclosure of this U.S. Pat. No. 2,972,550 is incorporated herein by reference as if the disclosure was recited in full text in this specification.

Generally, acetylene has been used as the combustible fuel gas because it produces both temperatures and pressures greater than those obtainable from any other saturated or unsaturated hydrocarbon gas. However, for some coating applications, the temperature of combustion of an oxygen-acetylene mixture of about 1:1 atomic ratio of oxygen to carbon yields combustion temperatures much higher than desired. As stated above, the general procedure for compensating for the high temperature of combustion of the oxygen-acetylene fuel gas is to dilute the fuel gas mixture with an inert gas such as nitrogen or argon. Although this dilution lowers the combustion temperature, it also results in a concomitant decrease in the peak pressure of the combustion reaction. This decrease in peak pressure results in a decrease in the velocity of the coating material propelled from the barrel onto a substrate. It has been found that with an increase of a diluting inert gas to the oxygen-acetylene fuel mixture, the peak pressure of the combustion reaction decreases faster than does the combustion temperature.

In U.S. Pat. No. 4,902,539 a novel fuel-oxidant mixture for use with an apparatus for flame plating using detonation means is disclosed. Specifically, this reference discloses that the fuel-oxidant mixture for use in detonation gun applications should comprise:

(a) an oxidant and (b) a fuel mixture of at least two combustible gases selected from the group of saturated and unsaturated hydrocarbons. The oxidant disclosed is one selected from the group consisting of oxygen, nitrous oxide and mixtures thereof and the like and the combustible fuel mixture is at least two gases selected from the group consisting of acetylene ($C_2H_2$), propylene ($C_3H_6$), methane ($CH_4$), ethylene ($C_2H_4$), methyl acetylene ($C_3H_4$), propane ($C_3H_8$), ethane ($C_2H_6$), butadienes ($C_4H_6$), butylenes ($C_4H_8$), butanes ($C_4H_{10}$), cyclopropane ($C_3H_6$), propadiene ($C_3H_4$), cyclobutane ($C_4H_8$) and ethylene oxide ($C_2H_4O$). The preferred fuel mixture recited is acetylene gas along with at-least one other combustible gas such as propylene. Thus detonation means using one combustible gas or combustible fuel mixtures of two or more combustible gases can be used to deposit the coating of this invention, provided the proper combination of temperature and pressure for the coating powders is obtained as described above.

To insure that the coating of this invention is impervious to an aqueous corrosion media, the coating should be capable of producing a current density of less than 50 microamperes per square centimeter when subjected to an applied potential of 400 millivolts according to the ASTM G-61 standard test method for conducting cyclic potentiodynamic polarization measurements for localized corrosion susceptibility of iron-, nickel-, or cobalt-based alloys. This test method describes a procedure for conducting cyclic potentiodynamic polarization measurements to determine relative susceptibility to localized corrosion (pitting and crevice corrosion) for iron-, nickel-, or cobalt-based alloys in a chloride environment. This test method also describes an experimental procedure which can be used to check one's experimental technique and instrumentation. The test procedure recited in ASTM Designation G61-86 is incorporated herein as if presented in its entire form. This test is a standard test procedure that is readily available at any library and is well known in the art.

DRAWINGS

EXAMPLE

Using the test procedure of ASTM G-61-86 (−86 means 1986 edition), along with a 3.5% by volume NaCl solution, the electrochemical corrosion studies on bare alloys and coated alloys were conducted. A potentiodynamic cyclic polarization technique was used to evaluate the corrosion behavior of the coating and alloys. Basically, in these tests about one centimeter square area of the sample is exposed to a corrosive media. A potential scan is started at some potential negative to the open circuit potential ($E_{corr}$) of the sample. This is termed cathodic polarization, since the sample becomes cathodic with respect to the counter electrode. During cathodic polarization the sample remains protected, and hydrogen evolution occurs at the sample. To study the corrosion behavior of the sample, potentials more positive than $E_{corr}$ have to be applied; i.e., anodic polarization. Starting the potential scan at some potential negative to $E_{corr}$ not only ensures the inclusion of $E_{corr}$ in the scan, but also that the data generated under cathodic polarization can be used for the polarization resistance measurements.

As the potential scan crosses the $E_{corr}$, corrosion (oxidation) of the sample occurs. The intensity of corrosion is measured by the resulting current between the sample and the counter electrode. The potential scan is reversed at a sufficiently high corrosion rate. Because of this reversal, the technique is termed "cyclic" polarization. Conventionally, applied potential is plotted at the y-axis and the resulting current density is plotted at the x-axis.

Figure 1:
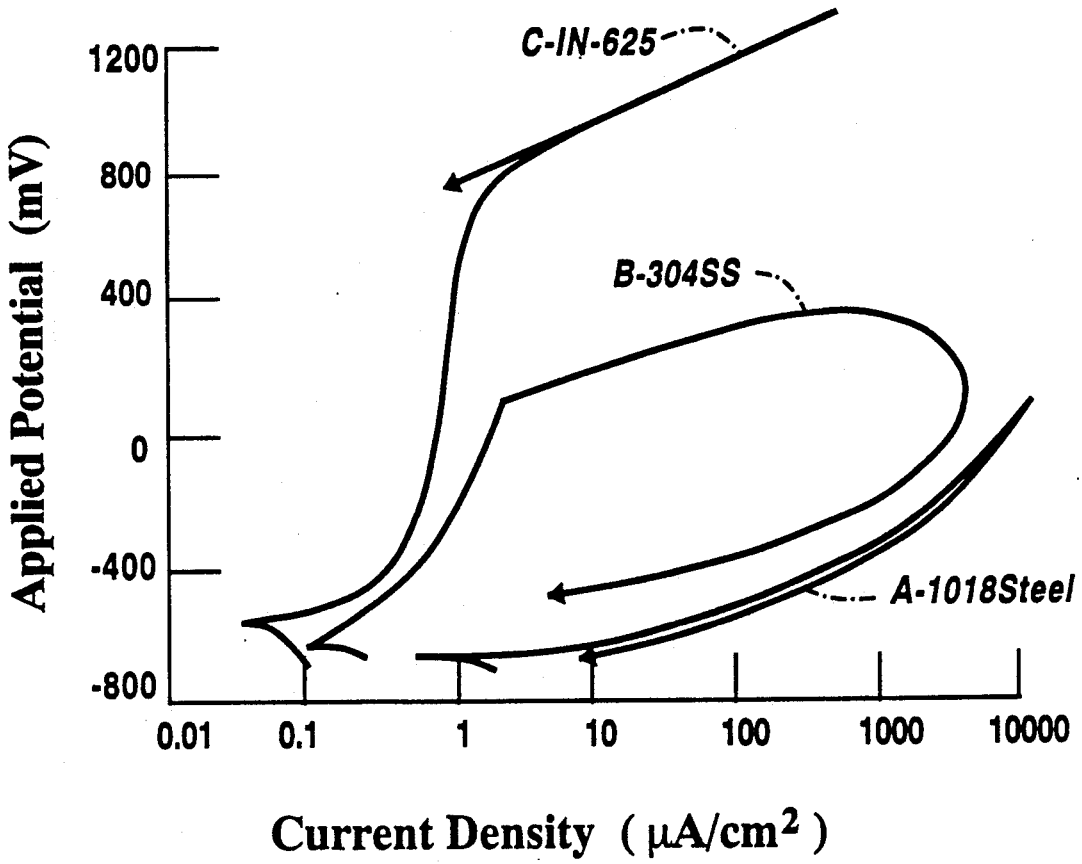
FIG. 1 shows a schematic representation of three cyclic potentiodynamic polarization curves for alloys in a 3.5% NaCl solution according to the standard corrosion test disclosed in ASTM G-61.

The cyclic polarization plots for samples of bare 1018 steel (Sample A), 304 stainless steel (Sample B) and IN 625 alloy (Sample C) are presented in FIG. 1 for ready reference as the base line data. In FIG. 1, the 304 stainless steel Sample B shows a typical pitting corrosion behavior. Breakdown of passivity occurs at about 200 mV which is marked by the rapid increase in current density due to pit initiation and growth. A hysteresis loop is formed as the direction of the scan is reversed due to continued and accelerated corrosion in the pits.

In FIG. 1 the IN 625 alloy Sample C does not show a pitting behavior. Passivity was maintained up to about 550 millivolts. The rapid increase in current which occurs at this potential is not due to pitting, it is due to uniform corrosion of the alloy in the transpassive region. In this region, the passive oxide layer starts to dissolve oxidatively, generally as a hydrolyzed cation in a higher oxidation state. The reverse scan for the IN 625 Sample B closely followed the forward scan. Since there were no pits, the corrosion of the alloy at a given potential remained the same in the reverse scan.

In FIG. 1 the 1018 steel Sample A shows a very negative corrosion potential ($E_{corr}$ value). The current density continued to rise with the applied potential in the forward direction without a discontinuous change in rate indicating rapid general corrosion.

The current density at 400 millivolts can be taken as the criteria distinguishing between materials that are corrosion resistant and materials that are not, since this potential is above the breakdown potential for alloys susceptible to localized corrosion and below the transpassivation potential for the most corrosion resistant alloys. It has been determined that materials with a corrosion current at 400 millivolts greater than about 50 microamps per square centimeter exhibit excessive corrosion on microscopic examination after the test while those with a corrosion current of less than 50 microamps exhibit no visible corrosion.

In addition to the alloy sample testing, a coating of this invention was thermal sprayed onto various alloy samples using the detonation technique. The coating was deposited at various gas temperatures and gas pressures to various thicknesses as shown in the Table. The coating of this invention that was used in the test was IN 625 powder which comprised 22% by weight Cr; 9% by weight Mo; 3% by weight Fe, 3.5% by weight Nb and balance Ni. The data obtained from the ASTM G-61 test for both the alloy samples and the coated alloy samples are presented in the Table. A plasma spray process was also used to coat one sample (Sample Q).

Figure 2:
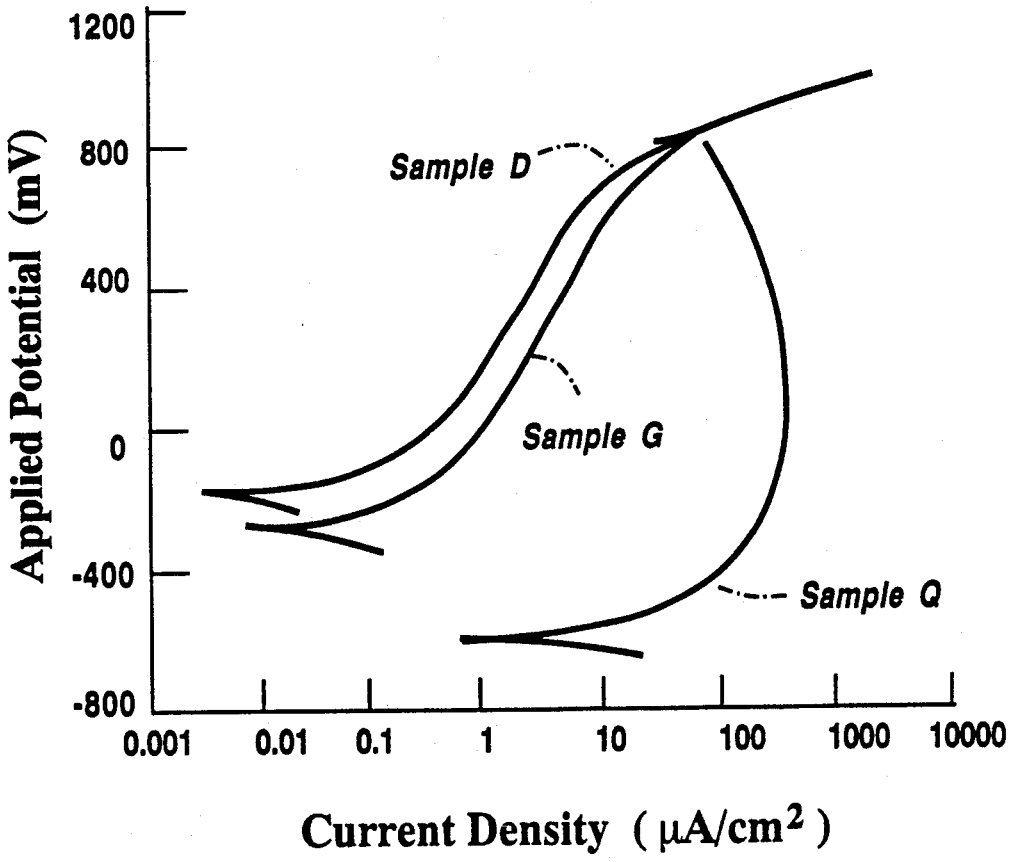
FIG. 2 shows a schematic representation of three cyclic potentiodynamic curves for IN-625 coatings put on different substrates and tested using a 3 5% NaCl solution according to the standard corrosion test disclosed in ASTM G-61.

FIG. 2 compares the polarization behavior of a coating of this invention on both IN-625 alloy (Sample D) and AISE 1018 alloy substrates with a prior art plasma spray coating of a similar composition on an AISI 1018 alloy (Sample Q) substrate. The polarization behavior of the samples with the coating of this invention are not affected by the type of substrate thus exhibiting impervious behavior, but the plasma spray coated sample of the prior art shows a high corrosion rate of the substrate because the coating is not effectively sealed and the substrate is attached.

The data in the Table show that an impervious coating of IN 625 powder was obtained when the powder was thermal sprayed at a gas pressure of from 12.0 to 16.7 atm, a gas temperature from 3259° F. to 5587° F. and a thickness of at least 0.0035 inch. The plasma sprayed coating was not impervious nor were the coatings that were deposited outside the gas pressure and gas temperature ranges recited above. As can be seen from the data, impervious coatings can be obtained from a specific powder composition if the powder composition is deposited using the thermal spray technique so that the powders can be applied within a specified gas temperature range and gas pressure range.

TABLE

| Sample | Coating | Substrate | $C_2H_2$ (Vol %) | $O_2$ (Vol %) | $N_2$ (Vol %) | $C_3H_6$ (Vol %) | PFR (g/min) | Temp (F.) | Pressure (ATM) | Coating Thickness (in) | Current Density @ 400 mV (UA/cm$^2$) | Impervious |
|---|---|---|---|---|---|---|---|---|---|---|---|---|
| A | None | 1018 St | | | | | | | | | 100000 | |
| B | None | 304 SS | | | | | | | | | 7000 | |
| C | None | IN 625 | | | | | | | | | 0.8 | |
| D | IN 625 | IN 625 | 12.5 | 57.5 | 0.0 | 30.0 | 45 | 3259 | 15.2 | 0.007 | 3 | Yes |
| E | IN 625 | IN 625 | 12.5 | 57.5 | 0.0 | 30.0 | 60 | 3259 | 15.2 | 0.007 | 4 | Yes |
| F | IN 625 | IN 625 | 12.5 | 57.5 | 0.0 | 30.0 | 90 | 3259 | 15.2 | 0.007 | 9 | Yes |
| G | IN 625 | 1018 St | 12.5 | 57.5 | 0.0 | 30.0 | 45 | 3259 | 15.2 | 0.007 | 5 | Yes |
| H | IN 625 | 1018 St | 12.5 | 57.5 | 0.0 | 30.0 | 60 | 3259 | 15.2 | 0.007 | 10 | Yes |
| I | IN 625 | 1018 St | 12.5 | 57.5 | 0.0 | 30.0 | 90 | 3259 | 15.2 | 0.007 | 20 | Yes |
| J | IN 625 | 1018 St | 26.7 | 54.6 | 0.0 | 18.6 | 60 | 4109 | 16.7 | 0.007 | 3 | Yes |
| K | IN 625 | 1018 St | 40.0 | 52.0 | 0.0 | 8.0 | 60 | 5487 | 18.9 | 0.007 | 200 | No |
| L | IN 625 | 1018 St | 17.8 | 20.0 | 61.5 | 0.0 | 60 | 3240 | 8.2 | 0.007 | 100 | No |
| M | IN 625 | 1018 St | 29.2 | 28.8 | 42.0 | 0.0 | 60 | 4450 | 12.0 | 0.007 | 20 | Yes |
| N | IN 625 | 1018 St | 40.2 | 39.7 | 20.0 | 0.0 | 60 | 5587 | 16.0 | 0.007 | 5 | Yes |
| O | IN 625 | 1018 St | 12.5 | 57.5 | 0.0 | 30.0 | 45 | 3259 | 15.2 | 0.004 | 200 | No |
| P | IN 625 | 1018 St | 12.5 | 57.5 | 0.0 | 30.0 | 45 | 3259 | 15.2 | 0.0035 | 25 | Yes |
| Q | IN 625* | 1018 St | | | | | 20 | | | 0.007 | 300 | No |
| R | IN 625 | 304 SS | 12.5 | 57.5 | 0.0 | 30.0 | 45 | 3259 | 15.2 | 0.007 | 5 | Yes |

TABLE-continued

| Sample | Coating | Substrate | $C_2H_2$ (Vol %) | $O_2$ (Vol %) | $N_2$ (Vol %) | $C_3H_6$ (Vol %) | PFR (g/min) | Temp (F.) | Pressure (ATM) | Coating Thickness (in) | Current Density @ 400 mV (UA/cm$^2$) | Impervious |
|---|---|---|---|---|---|---|---|---|---|---|---|---|
| S | IN 625 | 304 SS | 12.5 | 57.5 | 0.0 | 30.0 | 60 | 3259 | 15.2 | 0.007 | 5 | Yes |
| T | IN 625 | 304 SS | 12.5 | 57.5 | 0.0 | 30.0 | 90 | 3259 | 15.2 | 0.007 | 5 | Yes |

*Plasma Sprayed with a standard torch using 120 Amps current, 57 Volts, and Argon gas for shielding.

What is claimed is:

1. A process for protecting a metallic alloy from corrosion by applying an impervious coating to such alloy consisting essentially of the steps:

(a) preparing a metallic alloy substrate;

(b) preparing a powder comprising between 21 to 23 weight percent chromium; between 8 to 10 weight percent molybdenum; between about 2.5 to 3.5 weight percent iron; between about 3 to 4 weight percent niobium and remainder substantially nickel;

(c) thermal spraying the powder composition of step (b) at a selected gas temperature and gas pressure onto the metallic alloy substrate to produce a coating in excess of 0.0035 inch thick and having the characteristics such that when subjected to the ASTM G-61 corrosion test, a current density of less than 50 microamperes per square centimeter results when a potential of 400 millivolts is applied; and (d) depositing a coating on top of the coating of step (c), said coating selected from the group consisting of chromium oxide, aluminum chromium oxide, titanium oxide, mixed oxides of aluminum chromium and titanium, tungsten carbide cerments, tungsten carbide-cobalt cermets, tungsten carbide-nickel cermets, tungsten carbide-chromium-cobalt cermets, tungsten carbide-chromium-nickel cermets, chromium carbide-nickel-chromium cermets, chromium-carbide-IN-625 cermets, and tungsten-titanium carbide-nickel cermets.

2. The process of claim 1 wherein in step (b) the powder composition is about 22 weight percent ahromium, 9 weight percent molybdenum; about 3 weight percent iron; about 3.5 weight percent niobium; and remainder substantially nickel.

3. The process of claim 1 wherein in step (c) the gas temperature is between about 3000° F. and 5800° F. and the gas pressure is between about 11 atm and 18 atm.

4. The process of claim 3 wherein in step (c) the gas temperature is between about 3200° F. and 5600° F. and the gas pressure is between about 12 atm and 16.5 atm.

5. The process of claim 1 wherein the thickness of the coating is greater than 0.006 inch.

6. The process of claim 1 wherein a metallic alloy substrate is selected from the group consisting of AISE 304SS, AISE 316 SS, AISE 410 SS, austenitic stainless steel, ferritic stainless steel, martensitic steel, precipitation hardened stainless steel, plain carbon steel, alloy steel, copper-base alloy, aluminum-base alloy, nickel-base alloy, and cobalt-base alloys.

7. A coated iron-containing alloy substrate wherein the coated layer is a barrier coating consisting essentially of a composition of between 21 to 23 weight percent chromium; between about 8 to 10 weight percent molybdenum; between about 2.5 to 3.5 weight percent iron; between about 3 to 4 weight percent niobium and remainder substantially nickel; and said coating being impervious such that when subjected to the ASTM G-61 corrosion test, a current density of less than 50 microamperes per square centimeter results when a potential of 400 millivolts is applied and having a top coat over the barrier coating which is selected from the group consisting of chromium oxide, aluminum oxide, titanium oxide, mixed oxides of aluminum chromium and titanium, tungsten carbide cermets, tungsten carbide-cobalt cermets, tungsten carbide-nickel cermets, tungsten carbide-chromium-cobalt cermets, tungsten carbide-chromium-nickel cermets, chromium carbide-nickel-chromium cermets, chromium-carbide- IN-625 cermets, and tungsten-titanium carbide-nickel cermets.

8. The coated metallic alloy of claim 7 wherein the thickness of the coating is at least 0.0035 inch.

9. The coated metallic alloy of claim 7 wherein the thickness of the coating is at least 0.006 inch.

10. The coated metallic alloy substrate of claim 7 wherein the composition is about 22 weight percent chromium; about 9 weight percent molybdenum; about 3 weight percent iron about 3.5 weight percent niobium; and remainder substantially nickel.

11. The coated metallic alloy substrate of claim 7 wherein the substrate is selected from the group consisting of AISE 304SS, AISE 316 SS, AISE 410 SS, austenitic stainless steel, ferritic stainless steel, martensitic stainless steel, precipitation hardened stainless steel, plain carbon steel, alloy steel, copper-base alloy, aluminum-base alloy, nickel-base alloy, and cobalt-base alloy.

12. The coated metallic alloy substrate of claim 7 wherein the substrate is stainless steel and the top coat is a chromium carbide-containing coating.

13. The coated metallic alloy substrate of claim 7 wherein the substrate is austenitic stainless steel; the thickness of the barrier coating is at least 0.004 inch; and the top coat is a chromium carbide-containing coating.

14. The coated metallic alloy substrate of claim 7 wherein the substrate is a stainless steel and the top coat is tungsten carbide-containing coating.

15. The coated metallic alloy substrate of claim 7 wherein the substrate is a stainless steel and the top coat is tungsten carbide-chromium-nickel cermet.

16. The coated metallic alloy substrate of claim 7 wherein the substrate is stainless steel and the top coat is tungsten carbide-chromium-cobalt cermet.

17. The coated metallic alloy substrate of claim 7 wherein the substrate is stainless steel and the top coat is chromium carbide-IN 625 cermet.

18. The coated metallic alloy substrate of claim 7 wherein the substrate is stainless steel and the top coat is chromium carbide-nickel-chromium cermet.

19. A coated metallic alloy substrate consisting essentially of an impervious barrier coated layer of a composition of 21 to 23 weight percent chromium; between about 8 to 10 weight percent molybdenum; between about 2.5 to 3.5 weight percent iron; between about 3 to 4 weight percent niobium, and the remainder substantially nickel and having a top coated layer of a wear resistant coating.

* * * * *